US008359895B2

(12) United States Patent
Campian

(10) Patent No.: US 8,359,895 B2
(45) Date of Patent: Jan. 29, 2013

(54) MACHINE CELL WITH VACUUM NEST FOR HOLDING A METAL PANEL DURING A FORMING OPERATION

(75) Inventor: Jonathon Reo Campian, Troy, MI (US)

(73) Assignee: Modern Body Engineering Corporation, Madison Heights, MI (US)

( * ) Notice: Subject to any disclaimer, the term of this patent is extended or adjusted under 35 U.S.C. 154(b) by 107 days.

(21) Appl. No.: 12/825,833

(22) Filed: Jun. 29, 2010

(65) Prior Publication Data

US 2010/0319430 A1 Dec. 23, 2010

Related U.S. Application Data

(63) Continuation-in-part of application No. 11/679,731, filed on Feb. 27, 2007, now abandoned, which is a (Continued)

(51) Int. Cl.
*B21D 9/08* (2006.01)

(52) U.S. Cl. ..... 72/212; 72/213; 72/295; 269/20; 269/900

(58) Field of Classification Search ..... 72/212, 72/213, 295; 269/20, 21, 900, 903
See application file for complete search history.

(56) References Cited

U.S. PATENT DOCUMENTS 3,294,392 A * 12/1966 Dunham ..... 269/21
3,652,075 A * 3/1972 Thompson ..... 269/21
4,565,081 A 1/1986 Massee
4,682,928 A * 7/1987 Foulke et al. ..... 414/416.01
4,747,589 A * 5/1988 Watson et al. ..... 269/21
4,769,100 A 9/1988 Short et al.
4,802,948 A 2/1989 Zimmermann et al.
5,076,880 A 12/1991 Spengler et al.
5,141,212 A * 8/1992 Beeding ..... 269/21
5,228,190 A 7/1993 Sawa
5,237,734 A 8/1993 Polon
5,249,343 A * 10/1993 Grosso et al. ..... 29/281.4
5,375,951 A 12/1994 Veale
5,554,252 A 9/1996 Foran
5,572,786 A * 11/1996 Rensch ..... 29/559
5,695,865 A 12/1997 Shimizu
5,741,386 A 4/1998 Tomioka et al.
5,800,661 A 9/1998 Reis et al.
5,925,207 A 7/1999 Itoh et al.
6,187,654 B1 * 2/2001 Tieber ..... 438/464
6,217,013 B1 * 4/2001 Foreman ..... 269/21
6,638,791 B2 * 10/2003 Tieber ..... 438/113
6,672,576 B1 * 1/2004 Walker ..... 269/21
6,683,378 B2 * 1/2004 Wing et al. ..... 257/726
6,688,300 B2 * 2/2004 Tieber ..... 125/35

(Continued)

*Primary Examiner* — Bena Miller
(74) *Attorney, Agent, or Firm* — Harness, Dickey & Pierce, P.L.C.

(57) ABSTRACT

A lower die or nest apparatus is described to create a hemming environment that locates and holds a metal panel to a frame using suction in a manner that substantially resists said loads on the panel without damage or deformation. The vacuum nest includes a frame made of a rigid material with an outer work surface and an interior region with a sealed elongated channel shaped to the contour of the metal panel. A polymeric rope is inlayed within a groove formed in the interior region to form the sealed elongated channel. A support member may be formed within the channel by inlaying additional polymeric ropes into grooves formed within the channel. A vacuum source is fluidly coupled with the sealed elongated channel to create a downward force by evacuating the volume of the channel.

10 Claims, 5 Drawing Sheets

Related U.S. Application Data continuation-in-part of application No. 10/521,655, filed as application No. PCT/US2004/038993 on Nov. 19, 2004, now Pat. No. 7,254,973, application No. 12/825,833, which is a continuation-in-part of application No. 10/521,652, filed as application No. PCT/US2004/034238 on Oct. 15, 2004, now Pat. No. 8,202,388.

(60) Provisional application No. 60/523,961, filed on Nov. 21, 2003, provisional application No. 60/524,080, filed on Nov. 21, 2003, provisional application No. 60/511,468, filed on Oct. 15, 2003.

U.S. PATENT DOCUMENTS

| | | | | |
|---|---|---|---|---|
| 6,694,793 | B1 | 2/2004 | Persson | |
| 7,078,262 | B2 * | 7/2006 | Yamamoto et al. | 438/106 |
| 7,152,447 | B2 | 12/2006 | Toeniskoetter | |
| 7,254,973 | B2 | 8/2007 | Campian | |
| 7,406,759 | B2 * | 8/2008 | Yamamoto et al. | 29/559 |
| 7,987,888 | B2 * | 8/2011 | Yamamoto et al. | 156/755 |
| 2005/0217339 | A1 | 10/2005 | Toeniskoetter | |
| 2006/0075797 | A1 | 4/2006 | Baulier et al. | |
| 2006/0081331 | A1 | 4/2006 | Campian | |
| 2007/0209420 | A1 | 9/2007 | Campian | |

* cited by examiner

MACHINE CELL WITH VACUUM NEST FOR HOLDING A METAL PANEL DURING A FORMING OPERATION

CROSS-REFERENCE TO RELATED APPLICATIONS

This application is a continuation in part of pending U.S. Ser. No. 11/679,731, filed Feb. 27, 2007 which is a continuation in part of U.S. Ser. No. 10/521,655 filed on Jan. 14, 2005, now U.S. Pat. No. 7,254,973 issued Aug. 14, 2007 which is a National Phase of PCT/US04/38993 filed Nov. 19, 2004 which claims priority to U.S. Provisional Application No. 60/523,961 and to U.S. Provisional Application No. 60/524,080, both filed Nov. 21, 2003. This application is also a continuation in part of pending U.S. Ser. No. 10/521,652 filed Jan. 14, 2005 which is a National Phase of PCT/US04/034238 filed Oct. 15, 2004 which claims priority to U.S. Provisional Application No. 60/511,468 filed Oct. 15, 2003. The entire disclosure of the above-referenced applications are incorporated herein by reference.

FIELD

The present invention relates to systems for holding and aligning a first sheet material and a second sheet material for the joining thereof. More particularly, the present invention relates to an apparatus for holding a first sheet material and a second sheet material that utilizes a vacuum assembly for holding the first sheet material in place during the alignment of the second sheet material thereto and during the joining of the first sheet material to the second sheet material.

BACKGROUND

One of the earliest operations required in the history of automobile assembly was the joining of an inner panel to an outer panel to form any of a variety of body parts, including doors, engine hoods, fuel tank doors and trunk lids, all referred to as "swing panels" which enclose an opening in the vehicle body. Known machines for the forming and joining of sheet materials include the press-and-die set, and the tabletop and roller-forming tool, the latter being the most-recently introduced device.

An unfortunate feature of joining materials is that the sheets tend to become misaligned with each other before or during the joining operation, in part due to the lateral forces applied to the panels during the hemming operation. Certain efforts have been undertaken to overcome this problem.

One known effort employed to prevent the skidding of one sheet relative to the other has been to apply an upper pressure ring from above the sheet materials, thereby pinching the upper and lower sheets between the upper pressure ring and the lower nest member. This practice leads to the consumption of much of the workspace above the sheet materials. In addition, the use of the upper pressure ring requires a high-powered overhead device to effect operation. All considered, the use of the upper pressure ring is costly, inefficient and inconvenient.

An additional known practice to prevent skidding of two sheets during joining is to align the two sheets relative to one another from the side using side gauges. This operation, while offering certain advantages over the use of the upper pressure ring in terms of cost, space and equipment, does a poor job of controlling movement of the sheet materials. Fixture in the form of clamps around the perimeter of the panels ring also be employed to secure the panels. The use of gauges and clamps also leads to defacing of the sheet material through scratching during loading and unloading of the sheet material. Importantly, during operation, the gauges interfere with the travel of the forming tool. In some instances, if the gauges are spring-loaded, the rolling tool may be shocked and may suffer a pressure bounce when struck.

An additional practice has been to simply position one sheet above the other without holding, this latter approach clearly being the least desirable.

Prior approaches to the problem of forming and joining two sheet materials together while restricting movement of the sheets relative to one another had failed. While improving the state of the art, the method and apparatus of co-pending application Ser. No. 10/521,652 to Campian still had remnant sheet material movement. Moreover, even with that improvement, the manufacturing and precise positioning of the vacuum chamber(s) is complex and repair difficult.

Accordingly, prior approaches to solving the problem of providing a method and apparatus for forming and joining two sheet materials together while restricting movement of the sheets relative to one another have failed to overcome the problem.

SUMMARY

The system and method described herein streamlines the fabrication process of conventional lower nest assembly as described in Ser. No. 10/521,652 to Campian, thereby improving its effectiveness. The manufacturing accuracy increases as a computer numerically controlled mill can precisely cut grooves into the rigid top surface of the lower nest member. Polymeric seals are positioned within these grooves to form sealed elongated chambers which seal against a metal panel. So configured, the elongated chambers are coupled to a vacuum system which evacuates the elongated chambers for generating a downward clamping force sufficient to laterally immobilize the metal panel prior to execution of a metal forming procedure such as a hemming operation. The use of a nest with a vacuum clamping assembly formed within the lower die by a series of polymeric seals streamlines manufacturing in comparison to the molded chambers of U.S. Ser. No. 10/521,652 which require detailed machining and assembly to form an adequate sealed chamber.

The system described herein overcomes the problems of known techniques for forming and joining a first sheet material to a second sheet material to create a swing panel for an automobile. The machine cell described herein provides a definite method for aligning and securing a first panel to the lower nest and for aligning and securing the second panel to the first panel. Specifically, the system includes a vacuum nest for securely holding a metal panel during an edge hemming operation. A frame having a material contacting surface along an outer boarder of the frame conforms to an edge of a metal panel for providing support during the edge hemming operation. A relieved surface located interior and subjacent to the material contacting surface has a groove formed therein adjacent said material contacting surface. A polymeric seal is partial located with the groove and extends above the relieved surface to define a sealed elongated channel adapted to conform to the metal panel. A vacuum source is in fluid communication with the elongated channel and operates to evacuate the sealed elongated channel for generating a downward clamping force sufficient to immobilize the metal panel during the edge hemming operation in a direction generally parallel to the material contacting surface.

The vacuum nest may be incorporated into a larger machine cell may includes an array of crowders to align the first panel on the vacuum nest. The machine cell may also include an upper gate for aligning and holding a second panel relative to the first panel. As a result, the system and method described herein provides a machine cell which is efficient, cost-effective, and flexible enough to accommodate panels of various sizes, shapes, and contours.

DRAWINGS

The present invention will be more fully understood by reference to the following detailed description of the preferred embodiments when read in conjunction with the accompanying drawings, in which like reference characters refer to like parts throughout the views, and in which.

DETAILED DESCRIPTION

The drawings disclose the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

Figure 1:
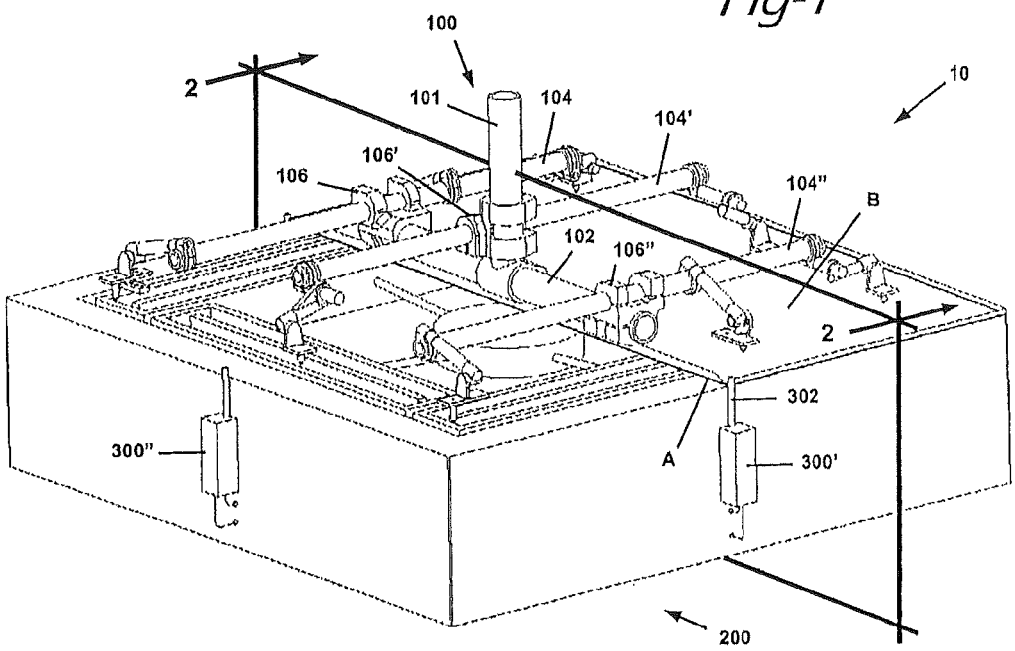
FIG. 1 is a perspective view of the preferred embodiment of the present invention.

With reference first to FIG. 1, the preferred embodiment of a machine cell, generally referred to as 10, is illustrated in a perspective view. The machine cell 10 includes an upper gate 100 and a lower nest 200. It should be understood that the configuration of the machine cell 10 as illustrated is preferred, but is not to be interpreted as limiting as other configurations conceivable to those skilled in the art may also be suitable.

Figure 5:
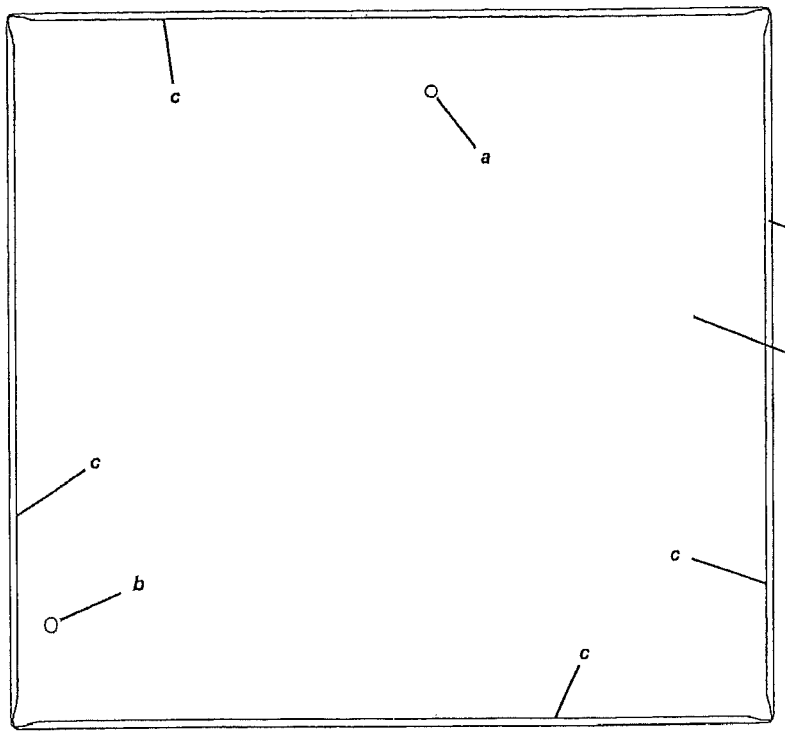
FIG. 5 is a top plan view substantially illustrating a sample inner sheet material or the support structure that forms the inner part of the resulting joined component.

The present invention serves to hold two portions of sheet material so that a joining process may be undertaken without the sheet material portions being caused to shift or otherwise move out of position. The two portions of sheet material include a first sheet material A and a second sheet material B. The two sheets A and B, in a combination resulting from joining and forming becomes an integrated component, of which the first sheet material A is the outer part or the skin and the second sheet material B is the inner part or the support structure. (This latter material is illustrated, by way of example, in FIG. 5, discussed below.) As illustrated, the first sheet material A and the second sheet material B have a generally square configuration resulting in a generally square-shaped integrated component. However, it is to be understood that other shapes may be suitable for use in the present invention.

In brief, the married sheet materials A, B are approximated onto the lower nest 200. The first sheet material A is then precisionly positioned by means of crowders, which will be discussed below primarily in relation to FIG. 1. Thereafter the upper gate 100 aligns the second sheet material B with respect to the first sheet material A by alignment pins as will be discussed below primarily in relation to FIG. 3. The first sheet material A is held in place by a vacuum applied to its under side. Thus held in place, a forming and joining operation may be effected for clinching the first sheet material A to the second sheet material B.

Figure 2:
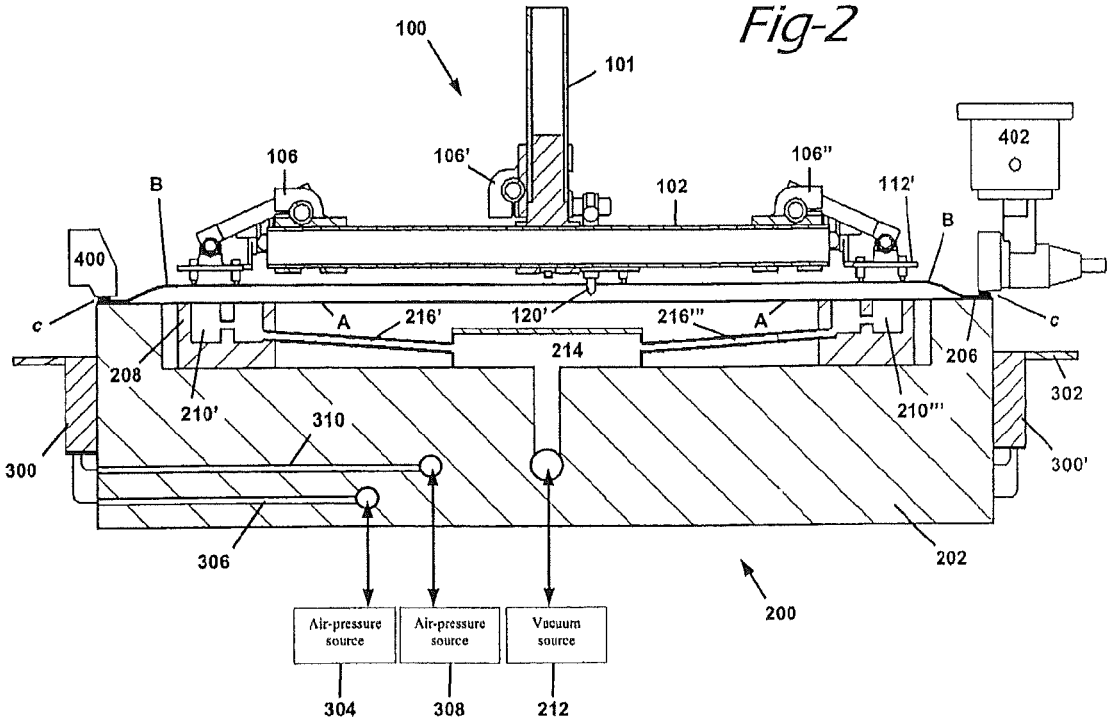
FIG. 2 is a sectional view taken along lines 2-2 of FIG. 1.
Figure 3:
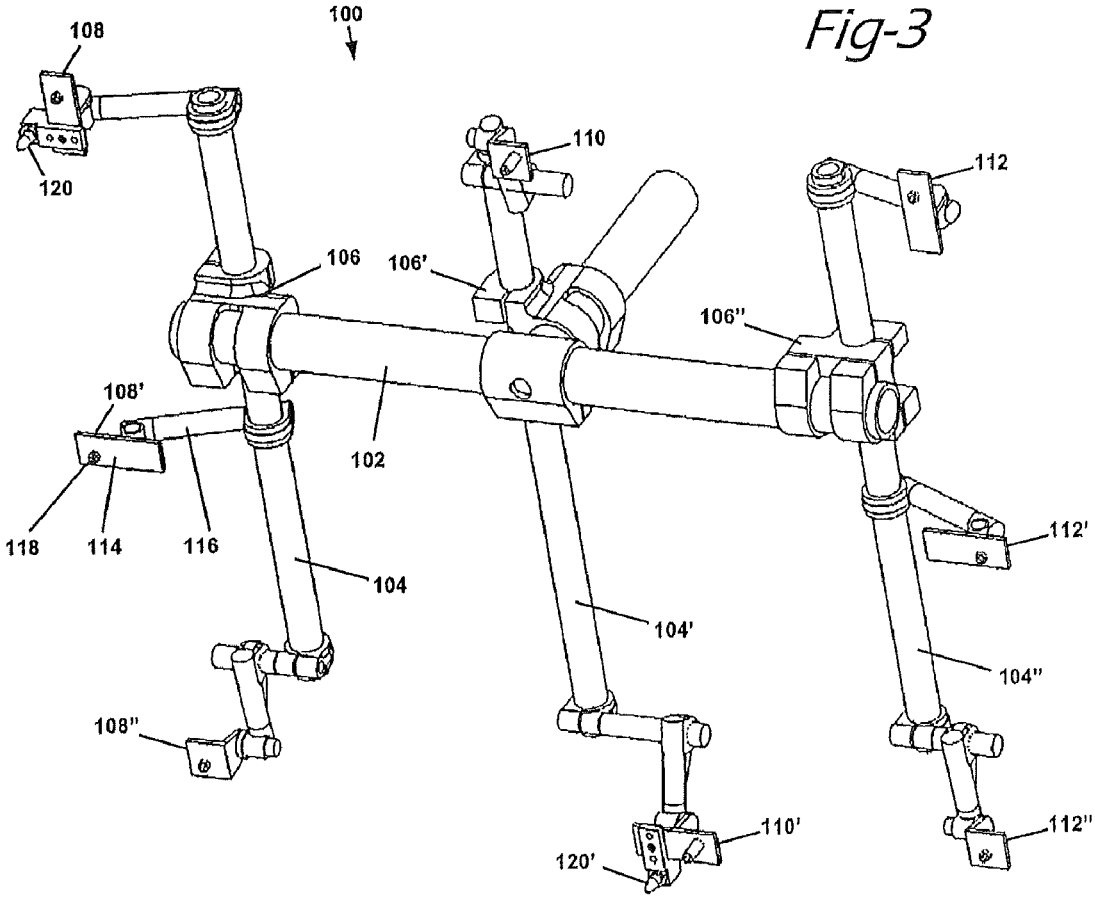
FIG. 3 is a perspective view of the upper gate of the present invention.

The upper gate 100 is shown in perspective view in relation to the entire machine cell 10 in FIG. 1, in sectional view in FIG. 2, and by itself in perspective view in FIG. 3. As illustrated in these figures, the upper gate 100 includes a main shaft 102 that is attached to a robotic arm or linear slide attachment shaft 101. The main shaft 102 is fixed in a substantially perpendicular position with respect to the robotic arm attachment shaft 101.

Pivotally attached to the main shaft 102 are three substantially parallel contact plunger support shafts 104, 104', 104". Each of the plunger support shafts 104, 104', 104" is attached to the main shaft 102 by a lockable swivel joint illustrated as lockable swivel joints 106, 106', 106". The lockable swivel joints 106, 106', 106" allow the support shafts 104, 104', 104" to be rotated with respect to the main shaft 102 thereby accommodating a variety of panels of different sizes and shapes. The composition of the shafts 102, 104, 104', 104" may be from a range of materials, including steel or aluminum.

Each of the plunger support shafts 104, 104', 104" preferably includes at least two contact plunger assemblies for firmly urging the second sheet material B against the first sheet material A. Specifically, contact plunger assemblies 108, 108', 108" are rotatably attached to the plunger support shaft 104, plunger assemblies 110, 110' are rotatably attached to the plunger support shaft 104', and plunger assemblies 112, 112', 112" are rotatably attached to the plunger support shaft 104".

Figure 4:
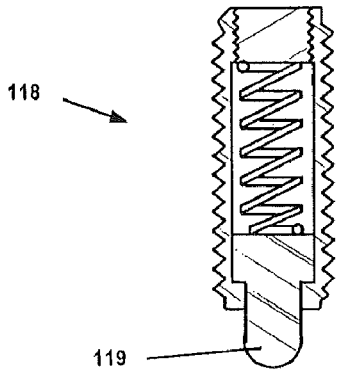
FIG. 4 is a sectional view of a spring plunger according to the present invention.

Each of the contact plunger assemblies 108 . . . 108", 110, 110', 112 . . . 112" includes a plunger body and an attachment shaft. Using plunger assembly 108' as an example and as illustrated in FIG. 4, a plunger body 114 is pivotally attached to a plunger attachment shaft 116, with the shaft 116 being rigidly fitted to the rotatable plunger support shaft 104. It should be noted that while in operation the rotatable plunger support shaft 104 is locked to the swivel joint 106. However, prior to operation, the swivel joint 106 may be loosened and the rotatable shaft 104 may be rotatably adjusted as needed to provide precise support for the second sheet material B.

Referring to FIG. 4, in addition to the plunger body 114, the plunger assembly 108' includes a plunger unit 118 which is preferably thread-fitted into the plunger body 114 thus allowing adjustability with respect to the plunger body 114. To safely yet firmly urge the second sheet material B against the first sheet material A, each plunger unit 118 includes a spring-loaded nose 119. The nose 119 may be made of a variety of materials, but is preferably made from a hard, non-marring material such as nylon. The plunger unit 118 could be of the type available from the Vlier Company of Brighton, Mass.

In addition to the function of applying pressure to urge the second sheet material B against the first sheet material A, the upper gate 100 also preferably provides an alignment function to align the second sheet material B with respect to the first sheet material A. The alignment function is accomplished by alignment pins acting in conjunction with circular and elongated alignment holes defined in the sheet material (in this case, sheet material B), which defines the inner part or the support structure of the resulting joined component. As illustrated in FIG. 3, certain ones of the plunger assemblies include alignment pins for engagement with the circular and elongated alignment holes of sheet material B. According to the preferred embodiment, the plunger assemblies 108 and 110' each include alignment pins 120, 120' respectively. The alignment pins 120, 120' include generally conical or pointed ends and function to engage alignment holes a and b shown in the sample second sheet material B illustrated in FIG. 5. It should be understood to one skilled in the art that the placement and number of alignment holes may be varied according to need.

Figure 6:
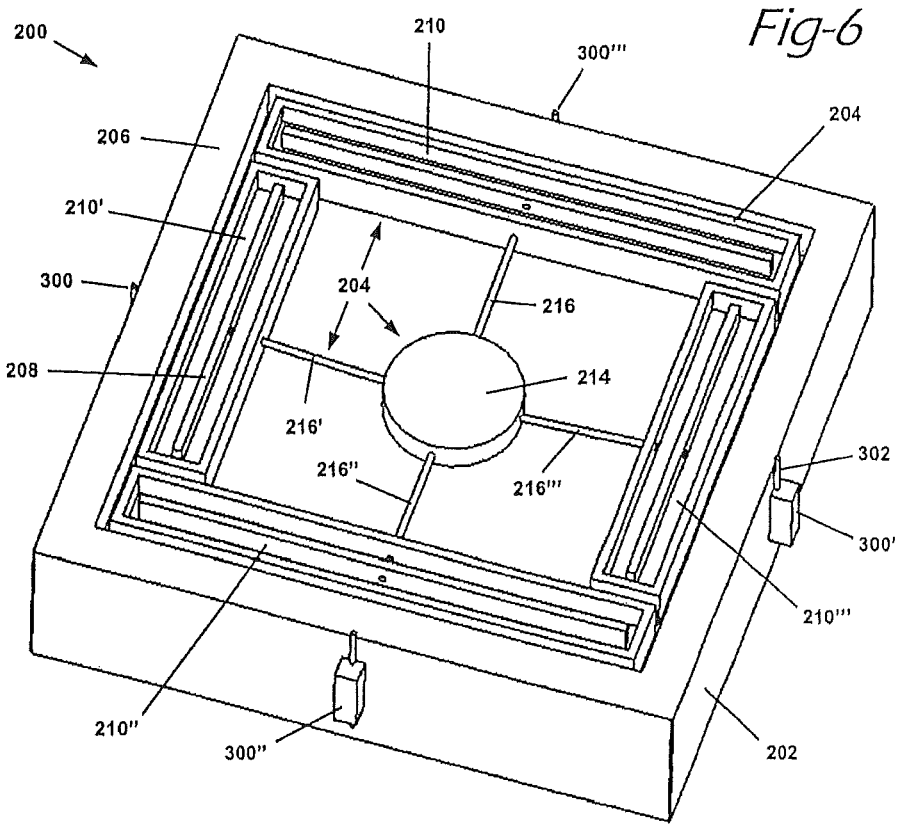
FIG. 6 is a perspective view substantially illustrating the top of the lower nest member shown in FIG. 2.

The lower nest 200 is partially illustrated in perspective view in FIG. 1 in conjunction with the upper gate 100, is illustrated in sectional view in FIG. 2 as taken along lines 2-2 of FIG. 1, and is shown in perspective view in FIG. 6 without the upper gate 100, or sheet materials A and B.

Referring then to FIGS. 1, 2 and 6, the lower nest 200 generally includes a frame 202 and a vacuum assembly 204. The frame 202, also known as an anvil, is configured so as to provide maximum support to the vacuum assembly 204, thus any one of a variety of configurations suitable for providing needed support may be adapted as known to one skilled in the art. The configuration shown is for illustrative purposes only. The frame 202 may be made from a variety of rigid materials, ranging from hard polymers to steel. The frame 202 includes an upper surface area 206 which provides support during the forming operation of the first sheet material A with the second sheet material B as is known in the art and as discussed further below with respect to the operation of the machine cell 10.

The vacuum assembly 204 includes one or more vacuum pads 208. Each of the vacuum pads 208 includes a series of vacuum channels 210, 210', 210", 210'''. This preferred arrangement allows for the appropriate degree of vacuum to be applied to the first sheet material A when positioned on the vacuum pads 208. While it is possible that other arrangements may be applied, such as a series of vacuum holes formed in a substantially solid nest surface or a series of vacuum cups, the illustrated arrangement of the vacuum channels 210, 210', 210", 210''' is preferred. Each of the vacuum pads 208 has an upper surface that is shaped to the contour of the first sheet material A.

Each vacuum pad 208 has a dual purpose—first, to provide a substantially air-tight seal with respect to the first sheet material A and, second, to provide a cushioned surface support for carefully supporting the first sheet material A while preventing its deformation. Accordingly, it is preferred that the vacuum pads 208 be composed of an elastic or semi-elastic polymerized material suitable for these purposes.

In addition to the vacuum pads 208, the vacuum assembly 204 includes necessary elements appropriate to the creation of a working vacuum within the channels 210, 210', 210", 210'''. FIG. 2 illustrates the preferred arrangement of vacuum lines for operation of the machine cell 10. A vacuum source, generally illustrated as 212, is provided and can be any one of such known sources. The source 212 is fluidly connected to a centrally located plenum 214. A series of vacuum lines 216, 216', 216", 216''', respectively fluidly connect the plenum 214 with the vacuum channels 210, 210', 210", 210'''.

Alignment of the second sheet material B with respect to the upper gate 100 is discussed above and is accomplished by use of alignment pins and alignment holes. Alignment of the first sheet material A with respect to the lower nest 200 may also be accomplished. To make the preferred alignment, two or more crowder assemblies 300, 300', 300", 300''' are provided on the lower nest 200 to correctly align the sheet material A. Each of the crowder assemblies 300, 300', 300", 300''' includes a movable alignment finger to effect alignment. Using the crowder assembly 300' as an example, a finger 302 is pivotally provided and is movable between a substantially vertical aligning position, as shown in FIGS. 1 and 4 and a substantially horizontal disengaged position, as shown in FIG. 2.

The crowder assemblies 300, 300', 300", 300''' are pneumatically operated and are each fluidly connected to two pressure sources, one for moving the finger into its substantially vertical aligning position and one for moving the finger into its disengaged position. By way of example, the crowder assembly 300 is fluidly connected to a first air pressure source 304 by a fluid line 306 which operates to hold the finger in its disengaged position. A second air pressure source 308 is connected to the crowder assembly 300 by a fluid line 310 which operates to hold the finger in its aligning position.

Forming and joining of the first sheet material A with the second sheet material B is accomplished by a known forming unit. As illustrated in FIG. 2, a die/tabletop steel-type-forming unit 400 may be used. Alternatively, or in addition, a roller-tool type of forming unit 402 may accomplish the operation of forming and joining. Detail as to the configurations of the forming units 400, 402 will be omitted as such is well known to those skilled in the art.

Figure 7:
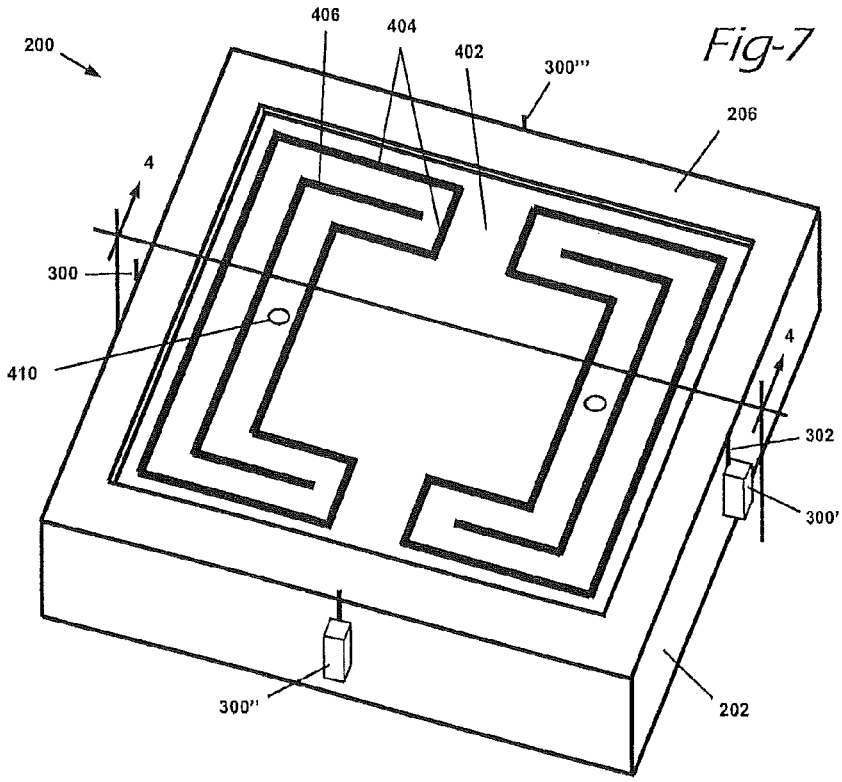
FIG. 7 is a perspective view substantially illustrating the top of an alternate lower nest member with sealed chambers similar to those illustrated in FIGS. 2 and 6.

With reference FIG. 6 and FIG. 7, the two figures have a similar lower nest 200 that generally includes a frame 202 and an upper surface area 206 which provides support during the forming operation of the first sheet material A with the second sheet material B as is known in the art. They also have similar crowders 300, 300', 300", and 300'''.

Figure 8:
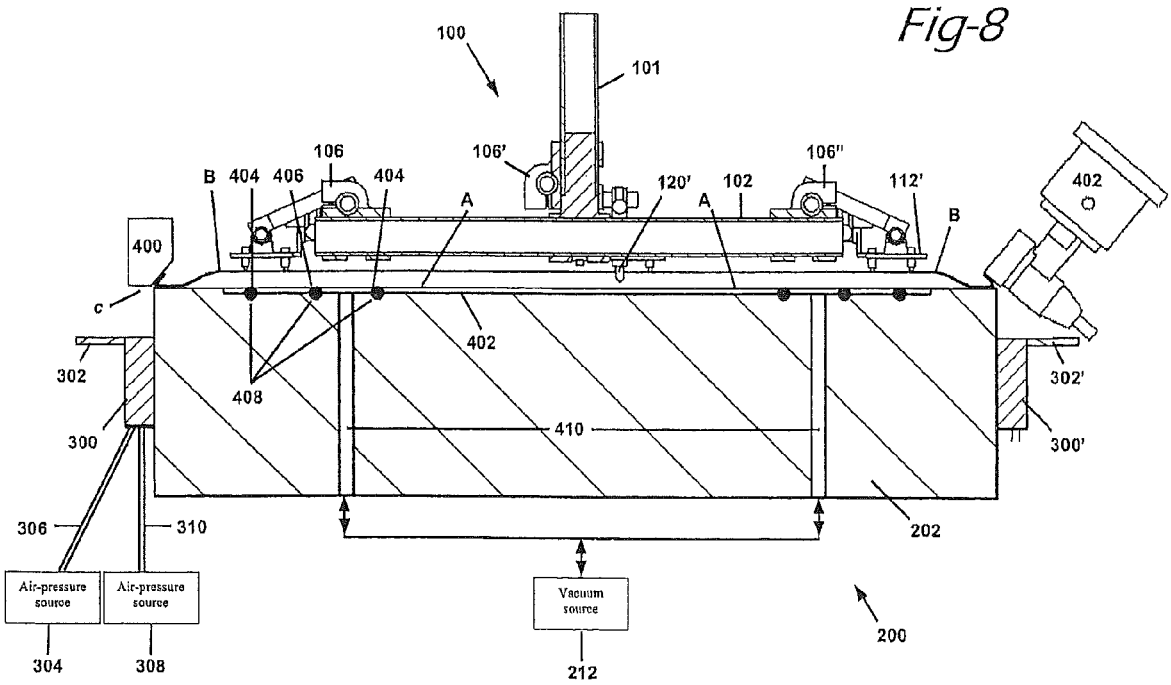
FIG. 8 is a sectional view taken along lines VIII-VIII of FIG. 7.

With reference to FIG. 2 and FIG. 8, the upper gate 100 is similar, including components 101, 102, 106, 106', 106", 112' and 120'. Also die/tabletop steel-type-forming unit 400 and roller-tool type forming unit 402 accomplish their operation of forming and joining similarly.

The vacuum assembly 204 includes one or more vacuum pads 208. Each of the vacuum pads 208 includes a series of vacuum channels 210, 210', 210", 210'''. The present invention presents a relieved surface 402 that is offset from the panel A surface approximately equal to the radius of ropes 404 and 406. The ropes 404 and 406 are of urethane or similarly elastic material. The relieved surface 402 has grooves 408 cut into it approximately equal to the radius of the ropes 404 and 406. The ropes 404 and 406 are laid in grooves 408 and adhered. The top of the exposed ropes 404 and 406 are thus in net contact with panel A throughout its length. A vacuum source is fluidly connected through hole 410. The peripheral rope 404 forming a closed shape acts as an air-tight seal and the inner rope(s) 406 acts as a support for the panel to prevent panel deformation.

Each rope 404 and 406 thus has an upper surface that is shaped to the contour of the first sheet material A. The ropes rest or are permanently glued into the grooves machined into the stiff lower nest material, generally metal, however other stiff materials work as well such as resins and plastics. This configuration makes the vacuum holding characteristics more ridged than the pads 208, permitting much less movement when side loading the panel A. Moreover, this configuration may be readily adapted to support and immobilize a wide variety of panel sizes and shapes.

Figure 9:
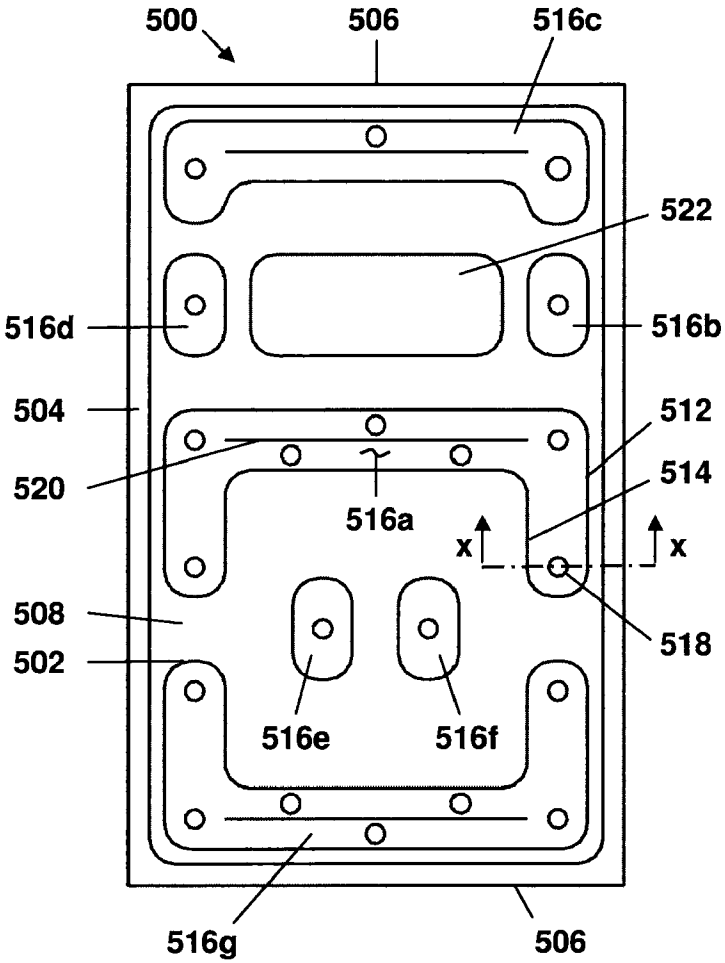
FIG. 9 is a top plan view of an alternate seal configuration of the lower nest member illustrated in FIG. 7 for supporting a vehicle roof panel having a sunroof opening.
Figure 10:
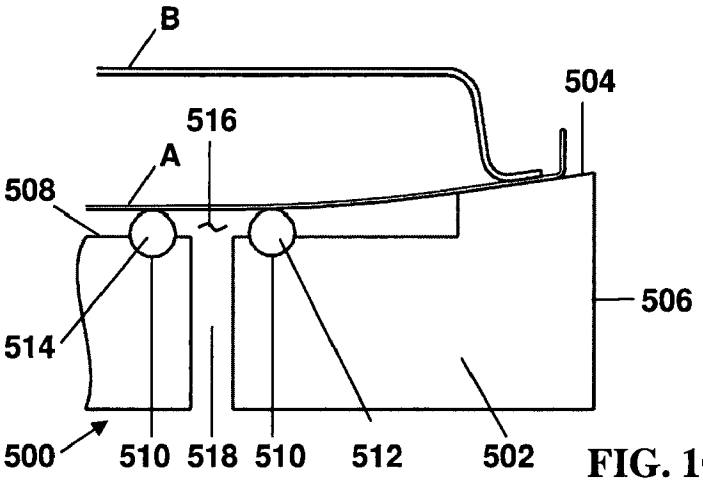
FIG. 10 is a cross-sectional view through a portion of the nest shown in FIG. 9 taken along line X-X.

For example, the lower nest 500 illustrated in FIGS. 9 and 10 includes a frame 502 having a material contacting surface 504 along an outer border 506 of the frame 502. The material contacting surface 504 conforms to an edge of metal panel A for providing support during an edge hemming operation. A relieved surface 508 is located interior and subjacent to the material contacting surface 504. Grooves 510 (shown in FIG. 10) are formed in the relieved surface 508 and receive polymeric seals 512, 514 in the form of a urethane rope. These seals may be of varying size to fill the space between the relieved surface 508 and the metal panel A, thereby forming an elongated sealed channel 516. In FIG. 10, the polymeric seals 512, 514 are shown to have a generally circular cross-section fitting into a generally semi-circular groove. However, it is contemplated that the polymeric seals used to define the elongated channels may have different configurations including various elliptical cross-sections or various polygonal cross-sections including but not limited to triangular, square, rectangular, trapezoidal and the like.

A vacuum source (shown in FIG. 8 as 212) is in fluid communication through passageway 518 with the elongated channel 516. The vacuum source operates to evacuate the sealed elongated channel 516 for generating a downward clamping force sufficient to immobilize metal panel A during the edge hemming operation in a direction generally parallel to the material contacting surface 504.

With reference now to FIG. 9, the frame 502 may include a number of numerous elongated sealed channels shown as 516*a-g*. The location and shape of these channels 516 are determined by the size, shape and configuration of the metal panel A. For example, channel 516*a-d* are configured to circumscribe a sun roof opening formed in a roof panel. Likewise, channels 516*e-g* would accommodate longitudinally-extending rails typically formed in a roof. A channel 516 may be subdivided within an interior seal such as seal 520 in channel 516*a*. The seal 520 functions to provide intermediate support across the width of the channel. Seal 520 is located with a groove (not shown) similar to that described above with reference to groove 510 and seals 512, 514.

The frame 502 may also include a fixture or support 522 extending from the relieved surface 508. The support 522 would be configured to extend into the sun roof opening. In this way, support 522 serves to located panel A onto the nest and further resist lateral movement during the forming operation.

Figure 11:
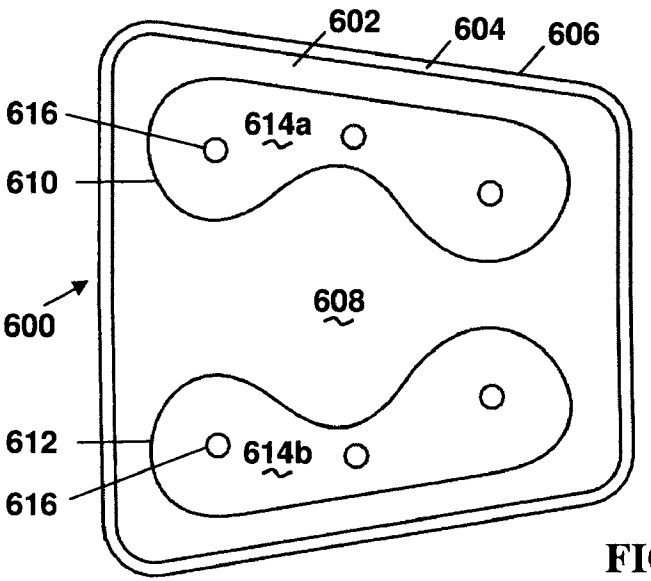
FIG. 11 is a top plan view of an alternate seal configuration of the nest illustrated in FIG. 7 for supporting a vehicle hood.

The lower nest 600 illustrated in FIG. 11 includes a frame 602 having a material contacting surface 604 along an outer border 606 of the frame 602. The material contacting surface 604 conforms to an edge of metal panel (not shown) for providing support during an edge hemming operation. A relieved surface 608 is located interior and subjacent to the material contacting surface 604. Polymeric seals 610, 612 extend from the relieved surface 606 to form elongated channels 614*a*, 614*b*. A vacuum source (shown in FIG. 8 as 212) is in fluid communication through passageways 616 with the elongated channel 614*a*, 614*b*. The vacuum source operates to evacuate the sealed elongated channels formed by a metal panel and elongated channels 614*a*, 614*b* for generating a downward clamping force sufficient to immobilize the metal panel in a direction generally parallel to the material contacting surface 604 during a forming operation.

The vacuum assembly described herein, which includes the sealed elongated channel conforming to the metal panel and the vacuum source in fluid communication with said elongated channel, replaces conventional fixturing devices such as clamps to immobilize the metal panel in a direction generally parallel to said material contacting surface during the metal forming operation. A distinct advantage of this vacuum assembly is the ability to secure the metal panel to the frame and onto the material contacting surface, while at the same time to enable unobstructed lateral movement of a forming tool to and from the material-contacting area across a boundary defined by the perimeter of the frame. To this point, forming tools 400, 402 (as shown in FIGS. 2 and 8) can move freely about the perimeter of the frame 200 and laterally with respect to the material contacting surface to engage and form the flanges on the metal panels.

The operation of the machine cell 10 will now be generally described. As the operation begins the upper gate 100 should already be in its elevated position, assuming that a joining operation has already been completed and the joined part has been removed, thus leaving the lower nest 200 empty.

Initially, a known quantity of mastic is applied to the approximate surface areas at which the first sheet material A will be joined to the second sheet material B. The mastic is utilized to provide a more complete joining of the sheet materials. The mastic may be joined to one of the sheets or to both as may be desired. Known mastics may include glass bead-filled compositions as are known in the art.

The machine cell 10 may then be operated by a human operator or by a programmable logic controller as is known in the art. Regardless of the form of the operator, reference shall be made hereafter generically to "the operator."

Once the mastic has been selectively applied to the sheets A and B, the operator marries the first sheet material A to the second sheet material B then places the combined sheets on the vacuum pads 208 with the first sheet material A face down (that is, the outer surface of the sheet material A is placed onto the vacuum pads 208). The crowder assemblies 300, 300', 300", 300''' are then activated by operation of the second air pressure source 308 to advance the alignment fingers to their engaged and aligning positions. So engaged, the first sheet metal A is in alignment relative to the lower nest 200. This arrangement facilitates positive micro positioning of the first sheet material A.

The operator then engages the robotic arm or linear slide (neither shown) to lower the upper gate 100 into an engaged position. The robotic control provides that movement of the upper gate 100 with a precise attitude. As the upper gate 100 is lowered, the alignment pins 120, 120' having generally conical or pointed tips as illustrated in FIG. 3 engage the circular and elongated alignment holes a and b of the sheet material B. The pointed configurations of the alignment pins allow for some degree of initial play with the fit becoming tighter as the upper gate 100 is lowered. Accordingly, as the upper gate 100 is lowered, the pins 120, 120' effect alignment by their engagement with the alignment holes a and b.

As the upper gate 100 is lowered and the alignment pins 120, 120' engage the alignment holes a and b, the second sheet material B is moved into alignment with the first sheet material A. The polymerized noses of the contact plunger assemblies 108 . . . 108", 110, 110', 112 . . . 112" apply a light pressure about the periphery of the second sheet material B, thus ensuring that the first sheet material A is nested onto the vacuum pads 208.

After the first sheet material A and the second sheet material B are in position, the vacuum source 212 is activated to provide a vacuum between the surface of the first sheet material A and the vacuum channels 210, 210', 210", 210'''. The first sheet material A is thus immobilized. With the combined assembly of the first sheet material A and the second sheet material B secured within the machine cell 10, the first air pressure source 304 is activated and the fingers of the crowder assemblies 300, 300', 300", 300''', 300''' are drawn away from their aligning positions to the substantially horizontal positions illustrated in FIG. 2. Thus positioned, the fingers will not interfere with the subsequent forming operation.

The joining operation then occurs, by which the upstanding flanges of material A are formed over onto material B resulting in clinched formation c. Formation c thus resides around part of or the entire periphery of the joined first sheet material A and the second sheet material B. As noted above, joining of the first sheet material A with the second sheet material B is accomplished by either the die/tabletop steel-type-forming unit 400 or the roller-tool-type-forming unit 402. Regardless of the chosen forming unit, the surface 206 of the frame 202 provides a rigid surface upon which forming operations may take place.

Once forming and joining of the first sheet material A to the second sheet material B is complete, the upper gate 100 is removed from the second sheet material B and the vacuum source 212 is de-energized causing the first sheet material A to be re-mobilized from the vacuum pads 208. The joined sheet materials A and B are unloaded from the top of the vacuum pads 208 and the next pair of married sheet materials A and B. is loaded. The forming and joining operation is thus repeated.

Those skilled in the art can now appreciate from the foregoing description that the broad teachings of the present invention can be implemented in a variety of forms. Therefore, while this invention has been described in connection with the particular examples thereof, the true scope of the invention should not be so limited since other modifications will become apparent to the skilled practitioner upon a study of the drawings, specification and following claims.

What is claimed is:

1. A vacuum nest for securely holding a metal panel during an edge hemming operation comprising:

a frame having a material contacting surface along an outer border of the frame which conforms to a border region of a metal panel for providing support during the edge hemming operation, and a relieved surface located interior and subjacent to the material contacting surface, the relieved surface having a continuous groove formed therein adjacent said material contacting surface; and a continuous polymeric seal partially located within the continuous groove and extending above the relieved surface forming an elongated channel, said polymeric seal conforming to a region of the metal panel interior of the border region to define an enclosed sealed elongated channel; and a vacuum source in fluid communication with said elongated channel and operable to evacuate said enclosed sealed elongated channel for generating a downward clamping force sufficient to immobilize the metal panel in a direction generally parallel to said material contacting surface during the edge hemming operation.

2. The vacuum nest of claim 1 wherein said groove has a semi-circular cross-section and said polymeric seal is a rope having a circular cross-section.

3. The vacuum nest of claim 1 wherein said seal is secured within said groove by an adhesive.

4. The vacuum nest of claim 1 further comprising an interior support located within said elongated channel and having a supporting surface on a free end opposite said relieved surface which substantially conforms to an interior region of the metal panel.

5. The vacuum nest of claim 4 wherein said interior support comprises a second groove formed in the relieved surface within the region defined by said enclosed sealed elongated channel, and a second polymeric seal partially located within the second groove and extending above the relieved surface.

6. The vacuum nest of claim 1 wherein said enclosed sealed elongated channel is a first enclosed sealed elongated channel, the vacuum nest further comprising:

a second continuous groove formed in the relieved surface adjacent said material contacting surface; and a second continuous polymeric seal partially located with the second groove and extending above the relieved surface forming a second enclosed elongated channel, said second continuous polymeric seal conforming with the metal panel to define a second enclosed sealed elongated channel;

wherein said vacuum source is in fluid communication with said first and second enclosed elongated channel;

wherein said vacuum source is operable to evacuate said first and second enclosed sealed elongated channels for generating a downward clamping force sufficient to immobilize the metal panel in a direction generally parallel to said material contacting surface during the edge hemming operation.

7. The vacuum nest of claim 6 wherein said first enclosed sealed elongated channel extends along a first border region of said frame and said second enclosed elongated channel extends along a second border region of said frame.

8. The vacuum nest of claim 1, wherein said vacuum assembly further comprises a plenum in fluid communication with said vacuum source and a fluid line connecting said plenum to said enclosed sealed elongated channel.

9. The vacuum nest of claim 1 further including at least one alignment mechanism fitted to said frame and operable to position the metal panel on said material contacting surface.

10. The vacuum nest of claim 9, wherein said at least one alignment mechanism comprises a crowder including an alignment finger pivotally positionable from a raised position wherein said alignment finger extends above said material contacting surface and a lowered position wherein said alignment finger retracts below said material contacting surface.

* * * * *